US012163105B2

(12) United States Patent
Thiebaut et al.

(10) Patent No.: US 12,163,105 B2
(45) Date of Patent: Dec. 10, 2024

(54) AQUEOUS COMPOSITION FOR LUBRICATING MOTORIZATION SYSTEMS

(71) Applicant: TOTAL ENERGIES ONETECH, Courbevoie (FR)

(72) Inventors: Benoît Thiebaut, Solaize (FR); Chantal Boyer, Solaize (FR)

(73) Assignee: TOTALENERGIES ONETECH, Courbevoie (FR)

( * ) Notice: Subject to any disclaimer, the term of this patent is extended or adjusted under 35 U.S.C. 154(b) by 0 days.

(21) Appl. No.: 18/011,932

(22) PCT Filed: Jun. 21, 2021

(86) PCT No.: PCT/EP2021/066816
§ 371 (c)(1),
(2) Date: Dec. 21, 2022

(87) PCT Pub. No.: WO2021/259853
PCT Pub. Date: Dec. 30, 2021

(65) Prior Publication Data

US 2023/0250359 A1 Aug. 10, 2023

(30) Foreign Application Priority Data

Jun. 22, 2020 (FR) ..... 2006498

(51) Int. Cl.
*C10M 173/02* (2006.01)
*C10N 10/02* (2006.01)
(Continued)

(52) U.S. Cl.
CPC ..... *C10M 173/02* (2013.01); *C10M 2201/02* (2013.01); *C10M 2203/1025* (2013.01);
(Continued)

(58) Field of Classification Search
CPC ..... C10M 173/02; C10M 2201/02; C10M 2203/1025; C10M 2207/0225;
(Continued)

(56) References Cited

U.S. PATENT DOCUMENTS 4,563,294 A * 1/1986 Geymayer ..... C10M 173/02 508/579
5,120,412 A 6/1992 Mazur et al.
(Continued)

FOREIGN PATENT DOCUMENTS

EP 0034132 A2 8/1981
EP 0432496 A2 6/1991
(Continued)

OTHER PUBLICATIONS

English-language machine translation of KR 2011-0015192A (Year: 2011).*
(Continued)

*Primary Examiner* — James C Goloboy
(74) *Attorney, Agent, or Firm* — The Marbury Law Group, PLLC

(57) ABSTRACT

The present invention relates to an aqueous lubricant composition for the lubrication of a stationary or mobile drive system, comprising at least: deionized water; at least one polyalkylene glycol; at least one antifreeze compound chosen from glycols, and at least one phosphorus compound.
(Continued)

It also relates to the use of this aqueous lubricant composition for the lubrication and cooling of a stationary or mobile drive system.

18 Claims, 1 Drawing Sheet

(51) Int. Cl.

| | |
|---|---|
| ***C10N 20/02*** | (2006.01) |
| ***C10N 30/00*** | (2006.01) |
| ***C10N 40/02*** | (2006.01) |
| ***C10N 40/04*** | (2006.01) |
| ***C10N 40/25*** | (2006.01) |

(52) U.S. Cl.
CPC ..... *C10M 2207/0225* (2013.01); *C10M 2209/1033* (2013.01); *C10M 2209/1045* (2013.01); *C10M 2209/1055* (2013.01); *C10M 2223/042* (2013.01); *C10N 2010/02* (2013.01); *C10N 2020/02* (2013.01); *C10N 2030/54* (2020.05); *C10N 2040/02* (2013.01); *C10N 2040/04* (2013.01); *C10N 2040/25* (2013.01)

(58) Field of Classification Search
CPC .. C10M 2209/1033; C10M 2209/1045; C10M 2209/1055; C10M 2223/042; C10N 2010/02; C10N 2020/02; C10N 2030/54; C10N 2040/02; C10N 2040/04; C10N 2040/25
See application file for complete search history.

(56) References Cited

U.S. PATENT DOCUMENTS

| | | | | |
|---|---|---|---|---|
| 7,195,783 | B2 | 3/2007 | Shan et al. | |
| 2009/0277298 | A1* | 11/2009 | Mayr | F16H 57/041 508/113 |
| 2012/0149616 | A1* | 6/2012 | Schmid-Amelunxen | C10M 173/02 508/463 |
| 2013/0035267 | A1* | 2/2013 | Schweigkofler | C10M 107/34 508/185 |
| 2015/0374595 | A1 | 12/2015 | Albrecht | |

FOREIGN PATENT DOCUMENTS

| | | | | |
|---|---|---|---|---|
| FR | 2453892 | A1 | | 11/1980 |
| GB | 1006940 | A | | 10/1965 |
| GB | 2046298 | A | | 11/1980 |
| KR | 2011015192 | A | * | 2/2011 |
| WO | 2017/151111 | A1 | | 9/2017 |
| WO | 2021/259853 | A1 | | 12/2021 |

OTHER PUBLICATIONS

International Search Report and Written Opinion for counterpart Application No. PCT/EP2021/066816, dated Oct. 12, 2021.
International Search Report and Written Opinion for counterpart Application No. PCT/EP2021/066814, dated Sep. 28, 2021.
Wölfle et al., "Topical Application of St. John's Wort (*Hypericum perforatum*)," Planta Medica, XP055440938, vol. 80, No. 02/03, Nov. 8, 2013, pp. 109-120.

* cited by examiner

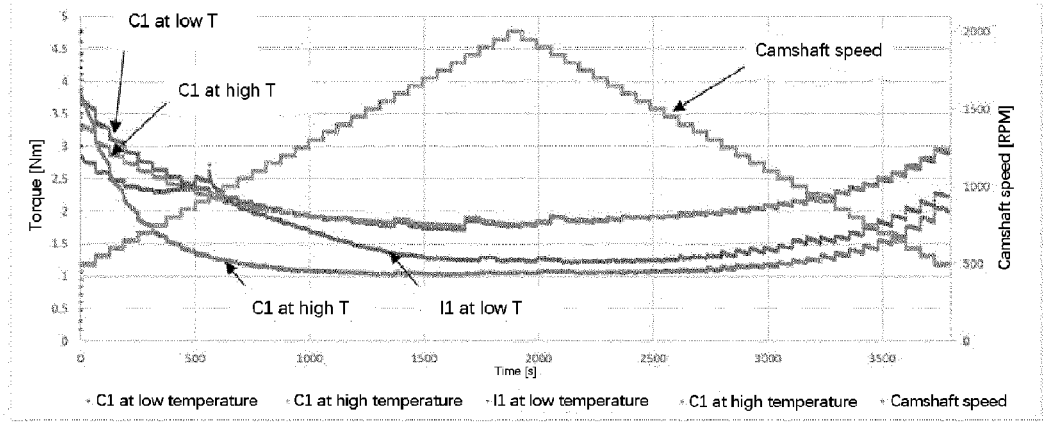
C1 at low T
C1 at high T
Camshaft speed
C1 at high T
I1 at low T
Torque [Nm]
Camshaft speed [RPM]
Time [s]
C1 at low temperature
C1 at high temperature
I1 at low temperature
C1 at high temperature
Camshaft speed

AQUEOUS COMPOSITION FOR LUBRICATING MOTORIZATION SYSTEMS

CROSS REFERENCE TO RELATED APPLICATIONS

This is a National Stage Application of PCT/EP2021/066816, filed internationally on Jun. 21, 2021, which claims priority to French Application No. 2006498 filed on Jun. 22, 2020, which are incorporated by reference herein in their entireties.

TECHNICAL FIELD

The present invention relates to the field of lubricant compositions, in particular lubricant compositions for the lubrication of mechanical systems, such as rolling bearings, gears, bearings or engines. In particular, the present invention relates to aqueous-based lubricant compositions for the lubrication of a mobile or stationary drive system.

PRIOR ART

Lubricant compositions, also referred to as "lubricants", are commonly used in mechanical systems, to reduce friction between parts and thus protect parts against wear. In addition to wear phenomena, friction can oppose the relative motion between parts in contact and induce energy losses that are detrimental to the optimal operation of the mechanical system.

Lubricants are used for multiple applications, for example for metalworking, in particular for metal deformation operations, for gas or steam turbines in the fields of aeronautics, shipping, railroad transport and electrical power generation, for motor vehicle propulsion systems, for example for the lubrication of bearings, gears, an engine, etc.

For example, in the field of lubricants for engines or transmissions of motor vehicles, the formulation of lubricants is an important issue insofar as they make it possible to have an effect on fuel consumption, and consequently on carbon dioxide emissions, via their impact on the frictional forces generated between the various parts of motor vehicles.

The most common lubricants are hydrocarbon-based lubricants. These hydrocarbon-based lubricants are conventionally composed of one or more base oils which are generally combined with several additives intended for stimulating the lubricant performance of the base oils, for instance friction-modifying additives.

Furthermore, the friction between the moving parts generates heat, and it may be necessary to jointly provide cooling of the mechanical systems. This cooling is typically provided by a coolant, different from the hydrocarbon-based lubricant, such as for example air, an aqueous fluid, such as water or else by a mixture of water and a glycol.

Nowadays, the development of new lubricants must take into account new constraints aimed at avoiding the use of toxic or potentially toxic solvents, or else reducing their environmental impact and carbon dioxide emissions. As such, water-based formulations are of increasing interest.

Although water is an excellent coolant, it does not however have the tribological properties required for a lubricant, in particular in terms of reducing friction and protecting parts against wear.

Water-based lubricant compositions, supplemented by various additives, have already been studied. For example, document US 2012/0149616 proposes an aqueous lubricant comprising, in addition to water, water-soluble polyalkylene glycols, emulsifiers, antifreeze additives of alkylene glycol or glycerol type, anticorrosion additives, antifoam additives and friction-reducing additives.

SUMMARY OF THE INVENTION

The present invention aims to provide a novel water-based composition, having tribological properties suitable for its use for the lubrication of mechanical systems.

More particularly, the present invention relates, according to a first of its aspects, to an aqueous lubricant composition for the lubrication of a stationary or mobile drive system, comprising at least:

- deionized water;
- at least one polyalkylene glycol;
- at least one antifreeze compound chosen from glycols, preferably alkylene glycols; glycerol; diglycerol; triglycerol, and mixtures thereof; and
- at least one phosphorus compound.

For the purposes of the present invention, the expression "aqueous composition" is understood to denote a composition comprising water as base fluid, in other words as the major solvent. In particular, water, preferably deionized water, preferably represents more than 35 wt % of the total weight of the lubricant composition.

For the purposes of the present invention, the expression "osmosed water" is understood to denote water which has undergone purification, in particular by a reverse osmosis process, in order to reduce the content of organic and/or mineral compounds, for example to a content of less than 5.0% by weight, preferably less than 1.0% by weight. In the remainder of the text, the expressions "demineralized water" or else "ultrapure water" will be considered as equivalent or synonymous with the expression "osmosed water". In particular, the osmosed water may be "deionized water", in other words water that has undergone purification in order to reduce the content of ions, such as $Ca^{2+}$ and $HCO_3^-$ ions generally present in water.

Preferably, a deionized water contains no ions.

In the remainder of the text, the expressions "aqueous lubricant composition" or "aqueous lubricant" will denote a lubricant composition according to the invention, intended to lubricate the moving parts in a mechanical system, and more particularly intended to lubricate a mobile or stationary drive system.

For the purposes of the present invention, a "drive system" is understood to denote a system comprising all the mechanical parts necessary for the intended mobile or stationary application and including at least one engine. It may be a combustion, gas, in particular hydrogen, aqueous ammonia, electric or hybrid drive system, depending on the nature of the engine(s) included in the drive system: combustion engine, gas engine, in particular hydrogen engine, aqueous ammonia engine and/or electric motor.

A "mobile" drive system is more particularly a drive system used in vehicles, including light vehicles, heavy-duty vehicles, "off-road" mobile machines, or else marine vehicles.

A mobile drive system thus corresponds more particularly to the propulsion system of a vehicle.

For the purposes of the present invention, a "propulsion system" is understood to denote a system comprising the mechanical parts required for propelling a vehicle. The propulsion system more particularly encompasses an engine, a transmission and optionally a battery.

The battery itself generally consists of a set of electric accumulators, referred to as cells. Advantageously, the mobile drive system is a propulsion system for an electric or hybrid vehicle. The propulsion system thus more particularly encompasses an electric motor comprising the rotor-stator assembly of the power electronics (dedicated to controlling the speed), a transmission and a battery.

For the purposes of the present invention, an "electric vehicle" is understood to denote a vehicle comprising an electric motor as sole means of propulsion, whilst a hybrid vehicle comprises a combustion engine and an electric motor as combined means of propulsion.

For the purposes of the present invention, a "stationary" drive system is a drive system that includes a stationary motor. It can for example find applications in devices for electric power generation. It may in particular be a gas drive system, in particular a stationary gas engine.

Against all expectations, the inventors have discovered that it is possible, by supplementing the water with the specific combination of at least one antifreeze compound chosen from glycols, at least one phosphorus compound and at least one polyalkylene glycol, to achieve an aqueous formulation with excellent tribological properties.

Advantageously, an aqueous lubricant composition according to the invention thus exhibits a performance in terms of reduction of friction between the moving parts in a mechanical system that is equivalent, or even improved, compared to that achieved using a conventional lubricant based on hydrocarbon oil(s).

The aqueous compositions according to the invention thus prove to be suitable for use as lubricants, for the lubrication of moving parts in a mechanical system, more specifically for the lubrication of a mobile or stationary drive system. They can thus be used in any system and for any application, replacing conventional hydrocarbon-based lubricants. Examples of application are given in the remainder of the text.

Thus, the present invention relates, according to another of its aspects, to the use of an aqueous lubricant composition according to the invention, for the lubrication of moving parts in a mechanical system, more specifically for the lubrication of a mobile or stationary drive system.

The present application relates in particular to the use of an aqueous lubricant composition according to the invention for the lubrication of a mobile drive system, in particular of a vehicle propulsion system, and more particularly of an electric or hybrid vehicle propulsion system.

The present application also relates to the use of an aqueous lubricant composition according to the invention, to reduce the friction between the moving parts in a mechanical system, in particular in a mobile or stationary drive system, more particularly in a vehicle propulsion system, and also to the use of an aqueous lubricant composition according to the invention to reduce the wear of parts in a mechanical system, in particular in a mobile or stationary drive system, more particularly in a vehicle propulsion system.

The invention also relates, according to another of its aspects, to a method for lubricating a mechanical system (or parts in a mechanical system), in particular in a mobile or stationary drive system, more particularly in a vehicle propulsion system, comprising at least one step of bringing at least one part of said mechanical system into contact with an aqueous lubricant composition according to the invention.

Advantageously, a composition according to the invention combines good cooling properties linked to the presence of water, and good tribological properties, in particular friction reduction and wear resistance properties. Thus, an aqueous composition according to the invention can advantageously provide the dual function of lubrication and cooling.

Thus, the present invention also relates to the use of an aqueous lubricant composition according to the invention, for the lubrication and cooling of moving parts in a mechanical system, in particular in a mobile or stationary drive system, more particularly in a vehicle propulsion system.

The present application relates in particular to the use of an aqueous lubricant composition according to the invention for the lubrication and cooling of a mobile drive system, in particular of a vehicle propulsion system, and more particularly of an electric or hybrid vehicle propulsion system.

It is thus possible to take advantage of an aqueous composition according to the invention to dispense with the use of two separate fluids, on the one hand a coolant, and on the other hand a lubricating fluid.

Also, a composition according to the invention has the advantage of being easy to formulate. In addition to the combined properties of cooling and lubrication, it has a good stability. Advantageously, it also has good anti-corrosion properties.

According to one application variant, an aqueous lubricant composition can be used for lubricating an engine or the transmission in a motor vehicle. These uses include bringing at least one component of the engine or transmission, in particular the gearbox or the axle, into contact with an aqueous lubricant composition according to the invention.

An aqueous lubricant composition according to the invention advantageously makes it possible to act effectively on fuel consumption via its impact on the frictional forces generated between the various components of motor vehicles. In particular, an aqueous lubricant composition proves to be very particularly advantageous for reducing friction in gearboxes, in axle differentials and/or in the cylinder head.

By thus reducing the friction between the moving parts in the propulsion system of the vehicle, a lubricant composition according to the invention makes it possible not only to reduce wear, but also to limit the energy losses responsible for excessive fuel consumption. An aqueous lubricant composition according to the invention thus advantageously has good properties in terms of reducing the fuel consumption of motor vehicles, also referred to as "Fuel Eco" properties, and, in fact, contributes to the reduction of $CO_2$ emissions.

The invention thus relates, according to another of its aspects, to the use of an aqueous lubricant composition according to the invention for reducing the fuel consumption of an engine, in particular of a vehicle engine, lubricated by means of this composition.

It also relates to the use of an aqueous lubricant composition according to the invention for reducing the fuel consumption of a vehicle equipped with a transmission, in particular an axle or a gearbox, lubricated by means of this composition.

Other features, variants and advantages of an aqueous lubricant composition according to the invention will emerge more clearly on reading the description and the examples that follow, which are given as nonlimiting illustrations of the invention.

The terms "between . . . and . . . ", "ranging from . . . to . . . ", "formed from . . . to . . . " and "varying from . . . to . . . " should be understood as being limits included, unless otherwise mentioned. In the description and the examples, unless otherwise indicated, the percentages are weight percentages. The percentages are therefore expressed by weight relative to the total weight of the composition. The temperature is expressed in degrees Celsius unless otherwise indicated, and the pressure is atmospheric pressure, unless otherwise indicated.

BRIEF DESCRIPTION OF THE DRAWINGS

FIG. 1 represents the friction torques measured by a "cylinder head bench" test for a composition in accordance with the invention (I1) and a comparative composition (C1), over a speed range of from 400 rpm to 2000 rpm.

DETAILED DESCRIPTION

Aqueous Composition

As mentioned above, an aqueous lubricant composition according to the invention, also referred to as an aqueous lubricant, is a formulation comprising water, in particular deionized water, as major solvent.

For the purposes of the invention, a "major solvent" is understood to mean that water is present in a greater amount than any other solvent possibly present in the composition. Preferably, an aqueous lubricant composition according to the invention comprises at least 35% by weight of water, in particular deionized water, preferably between 35% and 90% by weight, more preferentially between 40% and 75% by weight, relative to the total weight of the composition.

Advantageously, in addition to its role as solvent, water provides access to a lubricant composition having good cooling properties, and which can be used as a coolant for the moving parts in a mechanical system.

According to a particular embodiment, the water used in an aqueous lubricant composition according to the invention is deionized water, also referred to as demineralized water. Deionized water does not contain ions, such as the $Ca^{2+}$ and $HCO_3$ ions generally present in water, which are responsible for the conduction of electricity in water.

The use of deionized water is therefore particularly advantageous in the context of the use of the aqueous lubricant according to the invention for applications requiring a fluid that conducts little or no electricity, such as for example for the use of the aqueous lubricant for the lubrication and cooling of mechanical systems comprising an electrical circuit, for example electric or hybrid motors, in particular in electric or hybrid vehicles.

An aqueous lubricant composition according to the invention therefore differs from the lubricants conventionally used in mechanical systems, which comprise a major proportion of one or more water-insoluble base oils.

A "water-insoluble oil" is understood to mean in particular an oil which does not dissolve substantially in water at room temperature (at around 25° C.). In particular, a water-insoluble oil has a solubility in water of less than 0.2 g/L, at room temperature.

These include in particular lubricating base oils belonging to groups I to V according to the classes defined in the API classification (or their equivalents according to the ATIEL classification) and mixtures thereof.

Preferably, an aqueous lubricant composition according to the present invention comprises less than 5% by weight of water-insoluble base oil(s), preferably less than 2% by weight, more preferentially less than 1% by weight, relative to the total weight of the composition.

Advantageously, an aqueous lubricant composition according to the invention is completely free of water-insoluble oil.

Polyalkylene Glycol

As indicated above, an aqueous lubricant composition according to the invention comprises at least one polyalkylene glycol.

The polyalkylene glycols (denoted "PAG") are chosen from water-soluble polyalkylene glycols.

The term "water-soluble" is understood to denote a polyalkylene glycol having a solubility in water of at least 10 g/L, preferably of at least 500 g/L, in water at room temperature (around 25° C.).

The polyalkylene glycols can be more particularly formed from C1-$C_4$, preferably $C_1$-$C_3$ and more particularly $C_2$-$C_3$ alkylene oxide units.

Advantageously, a polyalkylene glycol used in an aqueous lubricant composition according to the invention comprises at least 50% by weight, in particular at least 80% by weight, more preferentially at least 90% by weight of propylene oxide and/or ethylene oxide units. It may be a copolymer, in particular a random copolymer, of ethylene oxide/propylene oxide.

Preferably, a polyalkylene glycol used in an aqueous lubricant composition according to the invention has a weight-average molar mass (Mn) of between 1000 and 20 000 $g \cdot mol^{-1}$, preferably between 5000 and 15 000 $g \cdot mol^{-1}$.

The number-average molar mass can be measured by gel permeation chromatography (GPC).

Preferably, a polyalkylene glycol used in an aqueous lubricant composition according to the invention has a kinematic viscosity measured at 100° C. (KV100), according to the ASTM D445 standard, of between 100 and 5000 $mm^2/s$, in particular between 150 and 3000 $mm^2/s$, and more particularly between 500 and 3000 $mm^2/s$.

Preferably, a polyalkylene glycol used in an aqueous lubricant composition according to the invention has a kinematic viscosity measured at 40° C. (KV40), according to the ASTM D445 standard, of between 500 and 30 000 $mm^2/s$, in particular between 1000 and 25 000 $mm^2/s$, or even between 5000 and 25 000 $mm^2/s$.

The flash point of a polyalkylene glycol used in an aqueous lubricant composition according to the invention is preferably above or equal to 160° C., in particular above or equal to 220° C.

The flash point can be measured by the ISO 2592 or ASTM D92 standard.

Preferably, a polyalkylene glycol used in an aqueous lubricant composition according to the invention has a viscosity index measured according to the ASTM D2270 standard, of between 100 and 800, preferably between 250 and 550.

In particular, said polyalkylene glycol compound(s) can be implemented in an aqueous lubricant composition according to the invention in a content of at least 5.0% by weight, preferably between 5.0% and 50% by weight, more preferentially between 10% and 40% by weight, in particular between 15% and 30% by weight, relative to the total weight of the composition.

Antifreeze Compound

As indicated above, an aqueous lubricant composition according to the invention comprises at least one antifreeze compound chosen from glycols, preferably alkylene glycols; glycerol; diglycerol; triglycerol, and mixtures thereof.

These compounds are known for their antifreeze action, in other words for reducing the freezing temperature of the composition.

Glycols are diols in which the two hydroxyl groups are borne by different carbon atoms, preferably by vicinal carbon atoms.

Preferably, the glycols are alkylene glycols, in particular having from 2 to 10 carbon atoms, in particular from 2 to 6 carbon atoms. As examples, mention may be made of monoethylene glycol, diethylene glycol and propylene glycol.

The antifreeze compound can also be chosen from glycerol, diglycerol, triglycerol and mixtures thereof.

Preferably, the antifreeze compound used according to the invention is chosen from monoethylene glycol, diethylene glycol, propylene glycol, glycerol and mixtures thereof. Preferably, the antifreeze compound is monoethylene glycol.

In particular, said antifreeze compound(s) can be implemented in an aqueous lubricant composition according to the invention in a content of at least 5.0% by weight, preferably between 5.0% and 35% by weight, more preferentially between 10% and 35% by weight, in particular between 15% and 30% by weight, relative to the total weight of the composition.

Phosphorus Compound

An aqueous lubricant composition according to the invention comprises at least one phosphorus compound, that is to say a compound comprising at least one phosphorus atom.

Preferably, the phosphorus compounds considered according to the invention do not introduce sulfur.

Said phosphorus compound(s) are advantageously used in a water-soluble or water-emulsifiable form, in particular in the form of ionic salts.

In particular, the phosphorus compound can be chosen from amine phosphates; phosphates such as phosphate esters, in particular alkyl, alkenyl or aryl phosphates; polyphosphates; phosphonates such as phosphonate esters, in particular alkyl, alkenyl or aryl phosphonates; polyphosphonates; carbamyl phosphates; phosphinates; and mixtures thereof.

The phosphorus compound(s) are preferably present in an aqueous lubricant composition according to the invention in the form of salts, in particular in the form of phosphate, phosphonate or phosphinate ions neutralized by an appropriate counterion.

The salts can be salts of alkali or alkaline-earth metals, of ammonium, of alkanolamines, in particular $C_2$-$C_8$ alkanolamines, or of alkaneamines, in particular $C_2$-$C_8$ alkaneamines, or phosphate, phosphonate or phosphinate salts.

Examples of compounds that are very particularly suitable for the invention are phosphate esters, phosphonate esters and salts thereof, preferably phosphate esters and salts thereof. Phosphate esters, also referred to as phosphoric acid esters, can be obtained by reacting at least one optionally ethoxylated, linear or branched alcohol, preferably at least one alcohol comprising between 1 and 18 carbon atoms, in particular between 1 and 14 carbon atoms, notably between 1 and 12 carbon atoms, more preferentially between 2 and 8 carbon atoms, with phosphorus pentoxide of formula $P_2O_5$ or with phosphoric acid.

Preferably, the phosphorus compound used in an aqueous composition according to the invention is chosen from phosphate esters, in particular alkyl, alkenyl or aryl phosphates, in particular aryl phosphates, more particularly ethoxylated aryl phosphates.

Such a compound can in particular be chosen from ethoxylated tridecyl alcohol phosphate ester, ethoxylated tristyrylphenol phosphate, and mixtures thereof.

The phosphate esters can be used in acid or neutralized form, in particular using a pH regulating additive, in particular chosen from ethanolamines, such as monoethanolamine (MEA), diethanolamine (DEA); triethanolamine (TEA), diglycolamine (DGA) isopropanolamines, such as monoisopropanolamine (MIPA), diisopropanolamine (DIPA) and triisopropanolamine (TIPA), ethyleneamines, such as ethylenediamine (EDA), diethylenetriamine (DETA), triethylenetetramine (TETA) and tetraethylenepentamine (TEPA), alkanolamines, such as methyldiethanolamine (MDEA), cyclamines, such as cyclohexylamine, 2-amino-2-ethyl-1,3-propanediol, 2-amino-2-methyl-1-propanol and mixtures thereof.

Advantageously, the phosphorus compound used in an aqueous composition according to the invention is chosen from salts of phosphate esters, in particular alkali metal salts of phosphate esters, in particular of $C_1$-$C_8$ alkyl or dialkyl phosphate esters.

Such a compound can in particular be chosen from potassium butylphosphate, potassium dibutylphosphate and mixtures thereof.

Some of these phosphorus compounds have already been proposed as antistatic agents in hydraulic fluids. However, to the knowledge of the inventors, such compounds have never been used in aqueous lubricant compositions.

An aqueous lubricant composition according to the invention may comprise less than 5.0% by weight of phosphorus compound(s) as defined above, in particular in the form of salt(s), in particular of salt(s) of phosphate esters, preferably from 0.1% to 5.0% by weight, more preferentially from 0.5% to 3.0% by weight, relative to the total weight of composition. According to a particular embodiment, an aqueous lubricant composition according to the invention may comprise a phosphorus content ranging from 0.016% to 0.40% by weight, in particular from 0.04% to 0.24% by weight and more particularly from 0.08% to 0.16% by weight.

Advantageously, an aqueous lubricant composition according to the invention may comprise a phosphorus content ranging from 0.010% to 0.40% by weight, in particular from 0.014% to 0.16% by weight and more particularly from 0.04% to 0.10% by weight.

The phosphorus content can be measured by ICP (Inductively Coupled Plasma).

According to a particular embodiment, an aqueous lubricant composition according to the invention comprises:

- water, preferably deionized water;
- at least one polyalkylene glycol, in particular as defined previously;
  - at least one antifreeze compound chosen from glycols, preferably alkylene glycols; glycerol; diglycerol; triglycerol, and mixtures thereof; preferably chosen from monoethylene glycol, diethylene glycol, propylene glycol, glycerol and mixtures thereof; and
- at least one phosphorus compound, in particular chosen from phosphate esters or salts thereof, in particular from:
  - the alkali metal salts of phosphate esters, in particular of $C_1$-$C_8$ alkyl or dialkyl phosphate esters, for example chosen from potassium butyl phosphate, potassium dibutyl phosphate;
  - ethoxylated alkyl, alkenyl or aryl phosphates, for example chosen from ethoxylated tridecyl alcohol phosphate ester, ethoxylated tristyrylphenol phosphate; and
  - mixtures thereof.

Additives

An aqueous lubricant composition according to the invention may further comprise various additives.

It is understood that said additive(s) are compatible with their use in an aqueous medium.

Advantageously, the additives are used in a water-soluble or water-emulsifiable form, for example in the form of ionic salts or liquids.

Said additive(s) are of course chosen with regard to the intended application for the aqueous lubricant.

Of course, those skilled in the art will take care to choose the possible additives and/or the amount thereof in such a way that the advantageous properties of the aqueous lubricant composition according to the invention, in particular the tribological properties, in particular of friction reduction and protection of parts against wear, and cooling properties, are not adversely affected by the proposed addition.

Such additives can be more particularly chosen from antifoaming agents, biocides, pH regulators, corrosion inhibitors, antiwear and/or extreme-pressure additives, sequesterants, metal passivators, dyes, dispersants, emulsifiers, and mixtures thereof.

Advantageously, an aqueous lubricant composition according to the invention may comprise one or more additives chosen from antifoaming agents, extreme-pressure agents, corrosion inhibitors, pH regulators, metal passivators, dyes, and mixtures thereof.

An aqueous lubricant composition according to the invention may more particularly comprise from 0.1% to 10% by weight, more preferentially from 1.0% to 8.0% by weight of additives, relative to the total weight of the composition.

Corrosion Inhibitor

An aqueous lubricant composition according to the invention may comprise at least one corrosion inhibitor. Corrosion inhibitors advantageously make it possible to reduce or even prevent corrosion of metal parts. The nature of said corrosion inhibitor(s) can be chosen with regard to the metal to be protected against corrosion, such as aluminum, steel, galvanized steel, yellow metals, for example copper or brass.

Mention may be made, among the inorganic corrosion inhibitors, of nitrites, sulfites, silicates, borates, sodium, potassium, calcium or magnesium phosphates, alkali metal phosphates, hydroxides, molybdates, sulfates of zinc, magnesium or nickel.

Mention may be made, among the organic corrosion inhibitors, of alkanolamines, such as triethanolamine, aliphatic monocarboxylic acids, in particular having from 4 to 15 carbon atoms, for example octanoic acid, aliphatic dicarboxylic acids having from 4 to 15 carbon atoms. carbon, for example decanedioic acid, undecanedioic acid, dodecanedioic acid or mixtures thereof, polycarboxylic acids optionally neutralized with triethanolamine, such as 1,3,5-triazine-2,4,6-tri-(6-aminocaproic) acid, alkanoylamidocarboxylic acids, in particular isononanoylamidocaproic acid, and mixtures thereof. Borate amides, products of the reaction of amines or amino alcohols with boric acid, can also be used.

An aqueous lubricant composition according to the invention may in particular comprise from 0.1% to 5% by weight of corrosion inhibitor(s), preferably from 0.5% to 4% by weight, more preferentially from 1% to 2.5% by weight, relative to the total weight of the composition.

Anti-Wear/Extreme-Pressure Additive

An aqueous lubricant composition according to the invention may comprise at least one anti-wear and/or extreme-pressure additive. Their function is to reduce wear and the coefficient of friction, or else to prevent metal-metal contact by forming an adsorbed protective film on these surfaces.

There is a wide variety of antiwear additives, among which mention may be made of those chosen from phosphorus-sulfur additives such as metal alkylthiophosphates or salts thereof. Additives that do not provide phosphorus may also be suitable, such as, for example, polysulfides, in particular sulfur-containing olefins.

According to a particular embodiment, an aqueous lubricant composition according to the invention comprises at least one extreme-pressure additive chosen from sulfur-containing fatty acids, and dimercaptothiadiazoles, preferably used in the neutralized, water-emulsifiable or water-soluble form thereof. Advantageously, an aqueous lubricant composition according to the invention comprises at least one extreme-pressure additive of sulfur-containing fatty acid type, preferably in a neutralized form, in particular neutralized by inorganic basifying agents or alkanolamines.

The sulfur-containing fatty acids can comprise from 8 to 22 carbon atoms, preferably from 12 to 18 carbon atoms.

The amount of sulfur according to the ASTM D2622 standard provided by said sulfur-containing fatty acid(s) can be between 5% and 30% by weight, in particular between 10% and 20% by weight.

Preferably, the amount of active sulfur at 150° C. according to the ASTM D1662 standard provided by said sulfur-containing fatty acid(s) in the aqueous lubricant composition according to the invention is greater than or equal to 2% by weight, in particular between 5% and 10% by weight, relative to the total weight of the lubricant composition.

For the purposes of the present invention, the expression "active sulfur" is understood to mean sulfur that a chemical compound is capable of yielding or releasing when this compound is placed under the conditions of the ASTM D1662 standard. The ASTM D-1662 standard defines an active sulfur content of a compound at a given temperature as a difference expressed as a weight percentage of sulfur content before and after reaction of a sample of this sulfur-containing compound with a given amount of copper over a fixed time. The amount of active sulfur at 150° C. (ASTM D1662 standard) in the aqueous lubricant composition of the invention can have an influence on its extreme-pressure performance. This amount of active sulfur at 150° C. (ASTM D1662 standard) in the lubricant composition must not be too low, otherwise satisfactory extreme-pressure behavior cannot be obtained. It must not be too high, to avoid risk of corrosion, in particular with respect to metals and metal alloys, in particular with respect to copper.

As mentioned above, said sulfur-containing fatty acid(s) are preferably used in an aqueous lubricant composition according to the invention in their form neutralized by a basifying agent, such as sodium hydroxide, potassium hydroxide, or an alkanolamine, such as monoethanolamine, triethanolamine, monoisopropanolamine, diisopropanolamine and triisopropanolamine.

An aqueous lubricant composition according to the invention may comprise between 0.01% and 10% by weight of anti-wear and/or extreme-pressure additive(s), in particular of sulfur-containing fatty acid(s), as defined above, preferably between 0.2% and 5% by weight, relative to the total weight of the composition.

Antifoam

An aqueous lubricant composition according to the invention may comprise at least one antifoam additive. Antifoams make it possible to prevent foaming of the lubricant fluid. It may be, for example, an antifoaming agent based on polysiloxanes or on acrylate polymers. Preferably, the antifoaming agent is chosen from three-dimensional siloxanes. Also, the antifoaming agents can be polar polymers such as polymethylsiloxanes or polyacrylates.

In particular, an aqueous lubricant composition according to the invention may comprise from 0.001% to 3.0% by weight of antifoam additive(s), preferably from 0.005% to 1.5% by weight, more preferentially from 0.01% to 1.0% by weight, relative to the total weight of the composition.

pH Regulator

An aqueous lubricant composition according to the invention may comprise at least one pH-regulating additive, in particular an alkaline buffer. The pH regulator makes it possible to maintain the desired pH of the lubricant composition, in particular in order to preserve an alkaline pH, advantageously between 8 and 11, so as in particular to prevent corrosion of the metal surfaces.

The pH regulator can be chosen from the family of amines, in particular alkanolamines and amino alcohols.

It may in particular be a pH-regulating additive chosen from ethanolamines, such as monoethanolamine (MEA), diethanolamine (DEA); triethanolamine (TEA), diglycolamine (DGA) isopropanolamines, such as monoisopropanolamine (MIPA), diisopropanolamine (DIPA) and triisopropanolamine (TIPA), ethyleneamines, such as ethylenediamine (EDA), diethylenetriamine (DETA), triethylenetetramine (TETA) and tetraethylenepentamine (TEPA), alkanolamines, such as methyldiethanolamine (MDEA), cyclamines, such as cyclohexylamine, 2-amino-2-ethyl-1,3-propanediol, 2-amino-2-methyl-1-propanol and mixtures thereof.

An aqueous lubricant composition according to the invention may in particular comprise from 0.1% to 10% by weight of pH-regulating additive(s), preferably from 0.5% to 5% by weight, relative to the total weight of the composition.

Metal Passivators

An aqueous lubricant composition according to the invention may comprise at least one metal passivator. Metal passivators make it possible to protect metal parts by promoting the formation of metal oxide on their surface.

The metal passivators can be chosen, for example, from triazole derivatives, such as tetrahydrobenzotriazole (THBTZ), tolyltriazole (TTZ), benzotriazole (BTZ), amines substituted by a triazole group, such as N,N-bis(2-ethylhexyl)-1,2,4-triazol-1-ylmethanamine, N'-bis(2-ethylhexyl)-4-methyl-1H-benzotriazole-1-methylamine, N,N-bis(heptyl)-ar-methyl-1H-benzotriazole-1-methanamine, N,N-bis(nonyl)-ar-methyl-1H-benzotriazole-1-methanamine, N,N-bis(decyl)-ar-methyl-1H-benzotriazole-1-methanamine, N,N-bis(undecyl)-ar-methyl-1H-benzotriazole-1-methanamine, N,N-bis(dodecyl)-ar-methyl-1H-benzotriazole-1-methanamine, N,N-bis(2-ethylhexyl)-ar-methyl-1H-benzotriazole-1-methanamine, 1,2,4-triazoles, benzimidazoles, 2-alkyldithiobenzimidazoles, 2-alkyldithiobenzothiazoles, 2-(N,N-dialkyldithiocarbamoyl)benzothiazoles, 2,5-bis(alkyldithio)-1,3,4-thiadiazoles, such as 2,5-bis(tert-octyldithio)-1,3,4-thiadiazole, 2,5-bis(tert-nonyldithio)-1,3,4-thiadiazole, 2,5-bis(tert-decyldithio)-1,3,4-thiadiazole, 2,5-bis(tert-undecyldithio)-1,3,4-thiadiazole, 2,5-bis(tert-dodecyldithio)-1,3,4-thiadiazole, 2,5-bis(tert-tridecyldithio)-1,3,4-thiadiazole, 2,5-bis(tert-tetradecyldithio)-1,3,4-thiadiazole, 2,5-bis(tert-pentadecyldithio)-1,3,4-thiadiazole, 2,5-bis(tert-hexadecyldithio)-1,3,4-thiadiazole, 2,5-bis(tert-heptadecyldithio)-1,3,4-thiadiazole, 2,5-bis(tert-octadecyldithio)-1,3,4-thiadiazole, 2,5-bis(tert-nonadecyldithio)-1,3,4-thiadiazole, 2,5-bis(tert-eicosyldithio)-1,3,4-thiadiazole, 2,5-bis(N,N-dialkyldithiocarbamoyl)-1,3,4-thiadiazoles, 2-alkyldithio-5-mercaptothiadiazoles, and mixtures thereof.

Preferably, the metal passivators are chosen from tetrahydrobenzotriazole (THBTZ), tolyltriazole (TTZ), benzotriazole (BTZ), and salts thereof, taken alone or as mixtures.

An aqueous lubricant composition according to the invention may in particular comprise from 0.01% to 2.0% by weight of metal passivator(s), preferably from 0.1% to 1.0% by weight, more preferentially from 0.2% to 0.8% by weight, relative to the total weight of the composition.

Dyes

An aqueous lubricant composition according to the invention may comprise one or more dyes. Dyes can be natural or synthetic, generally organic.

The dyes which can be used in an aqueous lubricant composition can be more particularly chosen from natural or synthetic water-soluble dyes, for example the dyes FDC Red 4, DC Red 6, DC Red 22, DC Red 28, DC Red 30, DC Red 33, DC Orange 4, DC Yellow 5, DC Yellow 6, DC Yellow 8, FDC Green 3, DC Green 5, FDC Blue 1, betanin (beet), carmine, chlorophyllin, methylene blue, anthocyanins (enocyanin, black carrot and hibiscus), caramel and riboflavin.

An aqueous lubricant composition according to the invention may comprise between 0.01% and 2.0% by weight of dye(s), preferably between 0.01% and 1.5% by weight, more preferentially between 0.02% and 1.0% by weight, relative to the total weight of the composition.

Emulsifiers

An aqueous lubricant composition according to the invention may comprise one or more emulsifiers, also referred to as emulsifying agents. Their role is to generate stable emulsions in water.

The emulsifiers may more particularly be nonionic, such as for example ethoxylated fatty alcohols, ethoxylated fatty acids, ethoxylated fatty amides; anionic, for example soaps of KOH or NaOH; sulfonates; cationic, such as quaternary ammonium compounds; or else water-soluble or water-emulsifiable carboxylic acid esters.

In particular, an aqueous lubricant composition according to the invention may comprise from 0.01% to 10% by weight of emulsifier(s), preferably from 0.1% to 5.0% by weight, relative to the total weight of the lubricant composition.

Sequestrants

An aqueous lubricant composition according to the invention may comprise at least one sequestrant. Sequestrants, also referred to as chelating agents, make it possible to limit the encrustation of metal ions in the composition.

As examples of sequestrants, mention may be made of those derived from phosphonic acids and phosphonates, such as diethylenetriamine pentamethyl phosphonic acid (DTPMPA), aminotri(methylene phosphonic) acid (ATMP), hydroxyethane diphosphonic acid (HEDP), 1-hydroxyethylidene 1,1-diphosphonate, 2-hydroxyethylamine di(methylene phosphonic acid) (HEAMBP), diethylene triaminopenta (methylene phosphonic acid) (DTMP), multifunctional organic acids and hydroxy acids, such as ethylenediaminetetraacetic acid (EDTA), pteroyl-L-glutamic acid (PGLU), organic polyacids, such as maleic acid and polyaspartic acid, polysaccharides and carbohydrates, such as inulin, carboxymethyl inulin and carboxymethyl chitosan.

An aqueous lubricant composition according to the invention may comprise from 0.001% to 2.0% by weight of sequestrant(s), preferably from 0.01% to 1.0% by weight, relative to the total weight of the composition.

Biocides and Fungicides

An aqueous lubricant composition according to the invention may comprise at least one biocidal and/or fungicidal agent. Biocides and fungicides can be used to improve the biological stability of the composition by limiting the proliferation of bacteria, fungi and yeasts in the lubricant fluid.

Such biocides can be chosen from parabens, aldehydes, reactive acetylacetone compounds, isothiazolinones, phenolic compounds, acid salts, halogenated compounds, quaternary ammoniums, certain alcohols and mixtures thereof.

Preferably, the biocides can be chosen from optionally substituted benzisothiazolinones (BIT), such as N-butyl-1,2-benzisothiazolin-3-one, methylisothiazolinones (MIT), mixtures of methylisothiazolinone and chloromethylisothiazolinone (MIT/CMIT), ortho-phenylphenol (OPP) or the sodium salt thereof, 3-iodo-2-propynyl butylcarbamate (IPBC), chlorocresol and N,N-methylenebismorpholine (MBM); sorbic acid; preferably from ortho-phenylphenol (OPP) or the sodium salt thereof, 3-iodo-2-propynyl butylcarbamate (IPBC), chlorocresol, benzisothiazolinones and N,N-methylenebismorpholine.

An aqueous lubricant composition according to the invention may in particular comprise between 0.01% and 10% by weight of biocide(s) and/or fungicide(s), preferably between 0.5% and 5.0% by weight, relative to the total weight of the composition.

According to a particular embodiment, an aqueous lubricant composition according to the invention comprises:

- at least 35% by weight of water, preferably deionized water;
- from 5.0% to 50% by weight of at least one polyalkylene glycol, in particular as defined above;
- from 5.0% to 35% of at least one antifreeze compound, chosen from glycols, preferably alkylene glycols; glycerol; diglycerol; triglycerol, and mixtures thereof; preferably chosen from monoethylene glycol;
- from 0.1% to 10% by weight of at least one phosphorus compound, in particular chosen from phosphate esters and salts thereof, in particular from:
  - the alkali metal salts of phosphate esters, in particular of $C_1$-$C_8$ alkyl or dialkyl phosphate esters, for example chosen from potassium butyl phosphate, potassium dibutyl phosphate;
  - ethoxylated alkyl, alkenyl or aryl phosphates, for example chosen from ethoxylated tridecyl alcohol phosphate ester, ethoxylated tristyrylphenol phosphate; and
  - mixtures thereof; and
- optionally from 0.1% to 10% by weight of one or more additives chosen from antifoaming agents, extreme-pressure agents, corrosion inhibitors, pH regulators, metal passivators, dyes, emulsifiers, sequestrants, and mixtures thereof.

the contents being expressed relative to the total weight of the lubricant composition.

In particular, an aqueous lubricant composition according to the invention may consist of:

- from 5.0% to 50% by weight of at least one polyalkylene glycol, in particular as defined above;
- from 5.0% to 35% of at least one antifreeze compound, chosen from glycols, preferably alkylene glycols; glycerol; diglycerol; triglycerol, and mixtures thereof; preferably chosen from monoethylene glycol;
- from 0.1% to 10% by weight of at least one phosphorus compound, in particular chosen from phosphate esters and salts thereof, in particular from:
  - the alkali metal salts of phosphate esters, in particular of C1-$C_8$ alkyl or dialkyl phosphate esters, for example chosen from potassium butyl phosphate, potassium dibutyl phosphate;
  - ethoxylated alkyl, alkenyl or aryl phosphates, for example chosen from ethoxylated tridecyl alcohol phosphate ester, ethoxylated tristyrylphenol phosphate; and
  - mixtures thereof; and
- optionally from 0.1% to 10% by weight of one or more additives chosen from antifoaming agents, extreme-pressure agents, corrosion inhibitors, pH regulators, metal passivators, dyes, emulsifiers, sequestrants, and mixtures thereof.

the contents being expressed relative to the total weight of the lubricant composition; the balance consisting of water, preferably deionized water.

Advantageously, a lubricant composition according to the invention has a kinematic viscosity, measured at 40° C. (KV40), according to the standard ASTM D445 (ISO 3104), of between 10 and 1000 $mm^2/s$, in particular between 20 and 300 $mm^2/s$ and more particularly between 25 and 80 $mm^2/s$.

The kinematic viscosity, measured at 100° C. (KV100), according to the standard ASTM D445 (ISO 3104), of a lubricant composition according to the invention can advantageously be between 3 and 50 $mm^2/s$, in particular between 4 and 25 $mm^2/s$ and particularly between 5 and 10 $mm^2/s$.

Advantageously, a lubricant composition according to the invention has a kinematic viscosity, measured at −10° C. (KV-10), according to the standard ASTM D445 (ISO 3104), of between 200 and 600 $mm^2/s$, in particular between 250 and 500 $mm^2/s$ and more particularly between 275 and 400 $mm^2/s$.

Application

As mentioned above, an aqueous lubricant composition formulated according to the invention, in particular as described above, has excellent tribological properties, in particular in terms of friction reduction and wear resistance, which makes it particularly well suited for use as a lubricating fluid.

Aqueous lubricant compositions can find various applications. In general, they can be used as a lubricating fluid for systems and applications, as a replacement for conventional hydrocarbon-based lubricants.

An aqueous lubricant composition according to the invention can thus be used for the lubrication of gears, rolling bearings, bearings, such as rolling or sliding bearings or else engines.

By way of example, an aqueous lubricant composition according to the invention can be used to lubricate mobile drive systems, in particular for the lubrication of the various components of motor vehicles, in particular of the transmission or of an engine, in particular the cylinder head of an internal combustion engine, for example of a vehicle engine. It advantageously makes it possible to reduce the friction between the parts of a vehicle propulsion system, such as the transmission and the engine.

As mentioned above, a lubricant composition according to the invention has excellent properties in terms of reduction in fuel consumption ("Fuel Eco" properties).

An internal combustion engine is generally divided into a part referred to as the "upper engine" consisting of at least one cylinder head assembled to the "lower engine". A cylinder head is a part that closes the top of the cylinder(s) of an engine. It ensures the distribution of the intake gases in the combustion chamber, via the intake duct and intake valves, and the discharge of the combustion gases, via an exhaust duct and exhaust valves. As illustrated in the examples, an aqueous lubricant composition according to the invention makes it possible to significantly reduce friction in a vehicle engine cylinder head.

A lubricant composition according to the invention can also be used for the lubrication of motor vehicle transmission components, in particular transmissions for light or heavy vehicles, for example gearboxes and/or axles.

In another application variant, an aqueous lubricant composition according to the invention can be used for metalworking, for example for the processing of metals, for example aluminum, steel, galvanized steel, yellow metals.

Advantageously, a lubricant composition according to the invention, formed mainly from water, has little toxicological impact, in particular for the people using this lubricant. Advantageously, even though water is the major solvent of an aqueous lubricant according to the invention, the treated surface is correctly lubricated.

In addition, the presence of a large proportion of water makes it easier to clean the surface to be treated, in particular by simple rinsing with water.

An aqueous lubricant composition according to the invention can also find an advantageous application for the lubrication of an electric or hybrid vehicle propulsion system, and more particularly of the engine, of the power electronics, of the transmission and/or of the battery. An aqueous composition according to the invention can thus be used both as a coolant and as a lubricant, for example in n electric or hybrid vehicle propulsion system. Advantageously, a composition according to the invention makes it possible to jointly achieve good properties in terms of cooling and lubrication of the parts of the electrical hybrid vehicle propulsion system.

More particularly, a composition according to the invention makes it possible to cool and lubricate an electric motor of an electric or hybrid vehicle. It is particularly effective for cooling the power electronics and/or the rotor and/or the stator of an electric motor. It also ensures lubrication of the rolling bearings located between the rotor and the stator of an electric motor of an electric or hybrid vehicle.

Advantageously, a composition according to the invention makes it possible to ensure the lubrication of the transmission, when it is present, in particular the reduction gear, of an electric or hybrid vehicle. Also, a composition according to the invention advantageously makes it possible to effectively cool the battery present in an electric or hybrid vehicle.

Thus, advantageously, it is for example possible, by using a single composition according to the invention, to ensure both the cooling of the battery and the lubrication of the transmission, in particular the reduction gear, in a electric or hybrid vehicle.

According to the invention, the particular, advantageous or preferred features of the composition according to the invention make it possible to define uses according to the invention that are also particular, advantageous or preferred.

The invention will now be described by means of the examples that follow, which are, needless to say, given as nonlimiting illustrations of the invention.

EXAMPLE

Friction Measurement

The performance of the compositions in terms of friction reduction are measured using a cylinder head test bench.

An engine cylinder head is driven by an electric generator in order to measure, by a torque sensor, the driving friction generated by the contact between the cam and the tappets.

The tests are carried out at a fixed pressure between 2.5 and 3.5 bar and at two different temperatures:

- a temperature between 32° C. and 40° C., referred to as "low temperature"; and
- a temperature between 58° C. and 62° C., referred to as "high temperature".

Rotation speed increase cycles are carried out for each temperature according to the following protocol:

- rinsing the cylinder head test bench with a rinsing oil containing detergent additives, followed by rinsing with a reference lubricant composition;
- once the first setpoint temperature is reached, adjusting the cylinder head inlet pressure;
- when the setpoint temperature is reached, launching the control program;
- succession of holds of approximately 60 seconds from 500 rpm to 2000 rpm, gradually increasing by 50 rpm at each hold, (i.e. 30 holds of 60 seconds—the passage between each hold lasts approximately 2 seconds);
- a hold of 60 seconds at 2000 rpm;
- succession of holds of approximately 60 seconds from 2000 rpm to 500 rpm, gradually increasing by 50 rpm at each hold, (i.e. again 30 holds of 60 seconds—the passage between each hold lasts approximately 2 seconds);
- repeat the procedure for the next temperature by adjusting the setpoint temperature to the desired temperature.

For each temperature and each speed hold, the average friction torque, the oil temperature at the cylinder head inlet and the standard deviation over the torque measurements are recorded.

The values are calculated over the last 30 seconds of each hold, and are averages over the last 2 cycles of each temperature.

At the end of the test: stopping the electric motor, then completely stopping the test bench.

Measurement of the Extreme-Pressure Properties

The performance of the compositions in terms of friction reduction are evaluated using two 4-ball tests according to the ASTM D2783 standard, adapted with the following parameters:

- speed close to 1500 rpm,
- room temperature, i.e. around 20° C.,
- load duration of 1 minute for the weld load measurement or 10 seconds for the measurement of the last non-seizure load,
- initial contact pressure of approximately 3.5 GPa.

The extreme-pressure measurement is carried out by rotating a stainless steel ball on three balls also made of stainless steel that are held immobile, the 4 balls being completely coated with a lubricant film. A load is applied to the balls and gradually increased (from 10 kg by 10 kg) until the balls weld together. The balls are changed before each increase in load. The extreme-pressure capacity corresponds to the value of the load at which the 4 balls are welded, preventing the rotation of the upper ball on the three others. The greater the load, the higher the extreme-pressure capacity.

Measurement of the Antiwear Properties

The antiwear properties of the lubricant compositions according to the invention were evaluated according to the ASTM D2670 standard, using a FALEX tribometer, under the following test conditions: test specimens: FALEX steel; break-in period: 300 s; test duration: 180 min; break-in load: 445 N; test load: 1335 N; speed: 290 rpm; and room temperature.

Example 1

Preparation of Lubricant Compositions According to the Invention and Comparative Compositions An aqueous lubricant composition (I1) according to the invention, and a comparative lubricant composition (C1)

based on group II and group III base oils, were formulated by simple mixing, at room temperature, of the following components, in the weight percentages indicated in table 1 below. The percentages are therefore expressed by weight relative to the total weight of the composition.

TABLE 1

| Composition | Composition (I1) according to the invention | Comparative composition (C1) |
|---|---|---|
| Group II base oil [%] | — | 71 |
| Group III base oil [%] | — | 15 |
| Deionized water [%] | 57.31 | — |
| Polyalkylene glycol [%] | 17.65 | — |
| Monoethylene glycol [%] | 20.52 | — |
| 8%(1) phosphate ester alkali metal salt [%] | 1.0 | — |
| Neutralized sulfur-containing fatty acid [%] | 0.7 | — |
| Anticorrosion additives [%] | 1.39 | — |
| Passivator [%] | 0.33 | — |
| Friction modifier [%] | — | 0.5 |
| Pour point depressant [%] | — | 0.2 |
| Antioxidant additive [%] | — | 1.5 |
| pH-regulating additive [%] | 1.07 | — |
| Antifoam additive [%] | 0.03 | — |
| Dye [%] | 0.03 | — |
| Additive package [%] | — | 12.3 |

(1)Phosphorus content [%] of the phosphorus compound

The aqueous lubricant composition I1 according to the invention has torque values which are always lower than those obtained for the comparative lubricant composition C1.

This demonstrates that the aqueous lubricant composition I1 according to the invention has a significant friction reduction compared to the use of a lubricant composition comprising at least one hydrocarbon base fluid (comparative composition C1).

In addition, the greater the friction reductions, the greater the fuel economy or Fuel-Eco. This therefore implies that the aqueous lubricant compositions according to the invention have improved properties in terms of Fuel Eco compared to oil-based lubricant compositions.

Example 3

Preparation of Lubricant Compositions in Accordance with the Invention

Three lubricant compositions in accordance with the invention (12, 13 and 14) were prepared by simple mixing, at room temperature, of the following components, in the weight percentages indicated in table 2 below. The percentages are thus expressed are as weight percentages relative to the total weight of the composition.

TABLE 2

| Composition | Composition (I2) according to the invention | Composition (I3) according to the invention | Composition (I4) according to the invention |
|---|---|---|---|
| Deionized water [%] | 57.31 | 57.31 | 57.31 |
| Polyalkylene glycol [%] | 17.65 | 17.65 | 17.65 |
| Monoethylene glycol [%] | 20.52 | 20.52 | 20.52 |
| 4.5%(1) ethoxylated phosphate ester [%] | 1.0 | — | — |
| 1.7%(1) ethoxylated tristyrylphenol phosphate (acid form) [%] | — | 1.0 | — |
| 1.4%(1) ethoxylated tristyrylphenol phosphate (neutralized form) [%] | — | — | 1.0 |
| Neutralized sulfur-containing fatty acid [%] | 0.7 | 0.7 | 0.7 |
| Anticorrosion additives [%] | 1.39 | 1.39 | 1.39 |
| Passivator [%] | 0.33 | 0.33 | 0.33 |
| pH-regulating additive [%] | 1.07 | 1.07 | 1.07 |
| Antifoam additive [%] | 0.03 | 0.03 | 0.03 |
| Dye [%] | 0.03 | 0.03 | 0.03 |
| Additive package [%] | 0.03 | | |

(1)Phosphorus content [%] of the phosphorus compound

Example 2

Characterization of the Compositions According to the Invention and Comparative Composition is Terms of Friction Reduction The friction torque induced by the aqueous lubricant composition according to the invention (I1) is compared for each speed and each temperature to the torque induced by the comparative oily lubricant composition (C1), in accordance with the measurement protocol defined above.

The results are summarized in FIG. 1, and show the friction torques for each composition at a given temperature over a speed range from 400 rpm to 1800 rpm. The lower the measured torque, the greater the friction reduction.

Example 4

Characterization of the Compositions According to the Invention and Comparative Composition is Terms of Extreme-Pressure and Antiwear Properties The extreme-pressure and antiwear properties of the lubricant compositions according to the invention in accordance with the measurement protocols defined above.

The results are compiled in table 3 below, and indicate the weld load values, the last non-seizure load and the wear expressed in μm. The higher the load value, the better the extreme-pressure properties. The lower the wear value, the better the antiwear properties.

TABLE 3

| Compositions | Composition (I1) | Composition (I2) | Composition (I3) | Composition (I4) |
|---|---|---|---|---|
| Last non-seizure load [DaN] | 126 | 100 | 100 | 100 |
| Weld load [DaN] | 49 | 44.8 | 43.4 | 42.8 |
| Wear [μm] | 84 | 100 | 102 | 105 |

Compositions I1, 12, 13 and 14 according to the invention have high load values, and therefore very good extreme-pressure properties.

Likewise, compositions I1, 12, 13 and 14 according to the invention have low wear values and therefore very good antiwear properties.

The invention claimed is:

1. A method of lubricating a drive system comprising a propulsion system of an electric or hybrid vehicle, comprising lubricating at least one part of the drive system using an aqueous lubricant composition comprising:

deionized water;

at least one polyalkylene glycol;

at least one antifreeze compound chosen from glycols, glycerol, diglycerol, triglycerol, or mixtures of two or more thereof; and at least one phosphorus compound.

2. A method of lubricating and cooling a drive system, the method comprising lubricating and cooling at least one part of the drive system comprising a propulsion system of an electric or hybrid vehicle, using an aqueous lubricant composition comprising:

deionized water;

at least one polyalkylene glycol;

at least one antifreeze compound chosen from glycols, glycerol, diglycerol, triglycerol, or mixtures of two or more thereof; and at least one phosphorus compound.

3. The method of claim 1 or claim 2, wherein the total amount of water in the aqueous lubricant composition is at least 35% by weight, relative to the total weight of the composition.

4. The method of claim 1 or claim 2, wherein the at least one polyalkylene glycol in the aqueous lubricant composition comprises at least 50% by weight of propylene oxide and/or ethylene oxide units.

5. The method of claim 1 or claim 2, wherein the at least one polyalkylene glycol in the aqueous lubricant composition has a kinematic viscosity ranging from 100 $mm^2/s$ to 5000 $mm^2/s$, measured at 100° C. (KV100) according to the ASTM D445 standard.

6. The method of claim 1 or claim 2, wherein the total amount of polyalkylene glycols in the aqueous lubricant composition is at least 5% by weight, relative to the total weight of the composition.

7. The method of claim 1 or claim 2, wherein the total amount of polyalkylene glycols in the aqueous lubricant composition ranges from 10% to 40% by weight, relative to the total weight of the composition.

8. The method of claim 1 or claim 2, wherein the antifreeze compound in the aqueous lubricant composition is chosen from monoethylene glycol, diethylene glycol, propylene glycol, glycerol, or mixtures thereof.

9. The method of claim 1 or claim 2, wherein the total amount of antifreeze compounds in the aqueous lubricant composition is at least 5% by weight, relative to the total weight of the composition.

10. The method of claim 1 or claim 2, wherein the total amount of antifreeze compounds in the aqueous lubricant composition ranges from 15% to 30% by weight, relative to the total weight of the composition.

11. The method of claim 1 or claim 2, wherein the phosphorus compound in the aqueous lubricant composition is chosen from salts of phosphate esters.

12. The method of claim 1 or claim 2, wherein the total amount of phosphorous compounds in the aqueous lubricant composition is less than 5% by weight, relative to the total weight of the composition.

13. The method of claim 1 or claim 2, wherein the total amount of phosphorus compounds in the aqueous lubricant composition ranges from 0.5% to 3% by weight, relative to the total weight of the composition.

14. The method of claim 1 or claim 2, wherein the aqueous lubricant composition further comprises at least one additive chosen from antifoam agents, biocides, pH regulators, corrosion inhibitors, anti-wear and/or extreme-pressure additives, sequesterants, metal passivators, dyes, dispersants, emulsifiers, or mixtures thereof.

15. The method of claim 1 or claim 2, wherein the aqueous lubricant composition further comprises an extreme-pressure additive chosen from sulfur-containing fatty acids, dimercaptothiadiazoles, or mixtures thereof.

16. The method of claim 1 or claim 2, wherein the aqueous lubricant composition comprises less than 5% by weight of water-insoluble oils, relative to the total weight of the composition.

17. A method of lubricating a hydrogen drive system or an aqueous ammonia drive system, comprising lubricating at least one part of the drive system using an aqueous lubricant composition comprising:

deionized water;

at least one polyalkylene glycol;

at least one antifreeze compound chosen from glycols, glycerol, diglycerol, triglycerol, or mixtures of two or more thereof; and at least one phosphorus compound.

18. A method of lubricating and cooling a hydrogen drive system or an aqueous ammonia drive system, the method comprising lubricating and cooling at least one part of the drive system, using an aqueous lubricant composition comprising:

deionized water;

at least one polyalkylene glycol;

at least one antifreeze compound chosen from glycols, glycerol, diglycerol, triglycerol, or mixtures of two or more thereof; and at least one phosphorus compound.

* * * * *